US009881624B2

(12) United States Patent
Choo et al.

(10) Patent No.: US 9,881,624 B2
(45) Date of Patent: Jan. 30, 2018

(54) METHOD AND DEVICE FOR ENCODING AND DECODING AUDIO SIGNAL

(71) Applicants: SAMSUNG ELECTRONICS CO., LTD., Suwon-si (KR); KWANGWOON UNIVERSITY INDUSTRY-ACADEMIC COLLABORATION FOUNDATION, Seoul (KR)

(72) Inventors: Ki-hyun Choo, Seoul (KR); Ho-chong Park, Seoul (KR); Eun-mi Oh, Seoul (KR)

(73) Assignees: SAMSUNG ELECTRONICS CO., LTD., Suwon-si (KR); KWANGWOON UNIVERSITY INDUSTRY-ACADEMIC COLLABORATION FOUNDATION, Seoul (KR)

( * ) Notice: Subject to any disclaimer, the term of this patent is extended or adjusted under 35 U.S.C. 154(b) by 0 days.

(21) Appl. No.: 14/891,515

(22) PCT Filed: May 15, 2013

(86) PCT No.: PCT/KR2013/004319

§ 371 (c)(1),
(2) Date: Nov. 16, 2015

(87) PCT Pub. No.: WO2014/185569

PCT Pub. Date: Nov. 20, 2014

(65) Prior Publication Data

US 2016/0118056 A1 Apr. 28, 2016

(51) Int. Cl.
*H04S 3/02* (2006.01)
*G10L 19/008* (2013.01)
(Continued)

(52) U.S. Cl.
CPC ..... *G10L 19/0204* (2013.01); *G10L 19/002* (2013.01); *G10L 25/18* (2013.01); *G10L 2019/0002* (2013.01)

(58) Field of Classification Search
CPC ..... H04S 3/02; G10L 19/008; G10L 19/265; G10L 2019/0002
(Continued)

(56) References Cited

U.S. PATENT DOCUMENTS 8,108,222 B2 1/2012 Tsushima et al.
8,271,267 B2 9/2012 Sung et al.
(Continued)

FOREIGN PATENT DOCUMENTS

EP 1342230 B1 4/2004
EP 1216474 B1 7/2004
(Continued)

OTHER PUBLICATIONS

Search Report dated Feb. 17, 2014, issued by the International Searching Authority in counterpart International Application No. PCT/KR2013/004319 (PCT/ISA/210).
(Continued)

*Primary Examiner* — George Monikang
(74) *Attorney, Agent, or Firm* — Sughrue Mion, PLLC

(57) ABSTRACT

A method is provided. The method includes obtaining a low-band spectrum of an audio signal in which a low-band signal is frequency transformed; obtaining phase information of a high-band spectrum of the audio signal based on the low-band spectrum; and outputting a bitstream that comprises the phase information of the high-band spectrum.

14 Claims, 9 Drawing Sheets

(51) Int. Cl.

| | |
|---|---|
| ***H04R 3/04*** | (2006.01) |
| ***G10L 19/02*** | (2013.01) |
| ***G10L 19/002*** | (2013.01) |
| ***G10L 25/18*** | (2013.01) |
| *G10L 19/00* | (2013.01) |

(58) Field of Classification Search
USPC ..... 381/22, 23, 97, 98
See application file for complete search history.

(56) References Cited

U.S. PATENT DOCUMENTS

| | | | | |
|---|---|---|---|---|
| 8,837,750 | B2 | 9/2014 | Disch et al. | |
| 9,190,067 | B2 | 11/2015 | Ekstrand et al. | |
| 2008/0249767 | A1* | 10/2008 | Ertan | G10L 19/005 704/219 |
| 2009/0325524 | A1* | 12/2009 | Oh | G10L 19/008 455/205 |
| 2011/0103591 | A1* | 5/2011 | Ojala | G10L 19/008 381/17 |
| 2013/0013325 | A1* | 1/2013 | Suzuki | G10L 21/038 704/500 |
| 2014/0297295 | A1 | 10/2014 | Villemoes et al. | |

FOREIGN PATENT DOCUMENTS

| | | | |
|---|---|---|---|
| JP | 4927264 | B2 | 5/2012 |
| JP | 2012-528344 | A | 11/2012 |
| KR | 10-2004-0063076 | A | 7/2004 |
| KR | 10-2007-0012194 | A | 1/2007 |
| KR | 10-2011-0128275 | A | 11/2011 |
| KR | 10-2011-0139294 | A | 12/2011 |

OTHER PUBLICATIONS

Written Opinion dated Feb. 17, 2014, issued by the International Searching Authority in counterpart International Application No. PCT/KR2013/004319 (PCT/ISA/237).

Nishiguchi, "Harmonic Vector Excitation Coding of Speech", Acoustical Science and Technology, vol. 27, No. 6, Apr. 2006, 9 pages total.

"Text of ISO/IEC 14496-3:2001/FDAM1, Bandwidth Extension", International Organisation for Standardisation, ISO/IEC JTC1/SC29/WG11 Coding of Moving Pictures and Audio, Mar. 2003, 127 pages total.

Griffin, et al.; "Multiband Excitation Vocoder", IEEE Transactions on Acoustics, Speech, and Signal Processing, vol. 36, No. 8, Aug. 1988, 13 pages total.

Communication dated Sep. 29, 2016, issued by the Korean Intellectual Property Office in counterpart Korean application No. 10-2015-7031431.

Tomasz Zernicki, et al., "Enhanced Coding of High-Frequency Tonal Components in MPEG-D USAC Through Joint Application of ESBR and Sinusoidal Modeling", ICASSP 2011, pp. 501-504.

Sang-Uk Ryu, et al., "Effective High Frequency Regeneration Based on Sinusoidal Modeling for MPEG-4 HE-AAC", 2005 IEEE Workshop on Applications of Signal Processing to Audio and Acoustics, Oct. 16-19, 2005, New Paltz, NY, pp. 211-214.

* cited by examiner

| INDEX | CODE VECTOR |
|---|---|
| 0 | $\{a_0\ a_1\ \ldots\ a_n\}$ |
| 1 | $\{b_0\ b_1\ \ldots\ b_n\}$ |
| 2 | $\{c_0\ c_1\ \ldots\ c_n\}$ |
| 3 | APPLY RANDOM PHASE |

METHOD AND DEVICE FOR ENCODING AND DECODING AUDIO SIGNAL

BACKGROUND

1. Field

Apparatuses and methods consistent with the present disclosure relate to encoding or decoding an audio signal, and more particularly, to a method and apparatus for encoding/decoding an audio signal by using a low-band spectrum to extend the bandwidth of the audio signal.

2. Description of Related Art

Signals in a high-frequency band (hereinafter, referred to as "high band") are less sensitive to a fine structure of a frequency than signals in a low-frequency band (hereinafter, referred to as "low band"). Therefore, to improve encoding efficiency so as to overcome a limitation in bits that may be used to encoding audio signals, many bits are assigned to encode the signals in the low band, whereas relatively fewer bits are assigned to encode the signals in the high band.

Spectral band replication (SBR) is a technology that employs the above-described method. SBR encodes the low band of a spectrum and encodes the high band thereof by using parameters such as an envelope. SBR uses the correlation between the low band and the high band so as to estimate the high band by extracting characteristics of the low band and using the characteristics.

A method of accurately extending bandwidth by using data having relatively fewer bits compared to the general SBR technology is required.

SUMMARY

Exemplary embodiments provide a method and apparatus for encoding/decoding an audio signal which is configured to correct a high-band spectrum, at a high resolution, that is generated by extending a low-band spectrum.

According to an aspect of an exemplary embodiment, there is provided a method of encoding an audio signal, the method including: obtaining a low-band spectrum of an audio signal in which a low-band signal is frequency transformed; obtaining phase information of a high-band spectrum of the audio signal based on the low-band spectrum; and outputting a bitstream that comprises the phase information of the high-band spectrum.

The obtaining of the phase information may include generating a phase codebook that comprises phase values of at least some bands of the low-band spectrum.

The obtaining of the phase information may include determining a plurality of sub-bands comprised in the low-band spectrum; assigning an index to each of the plurality of sub-bands; and mapping phase values of each of the plurality of sub-bands to the assigned index of the sub-band.

The obtaining of the phase information may further include generating a phase codebook that comprises phase values of each of a plurality of sub-bands comprised in the low-band spectrum and generating a plurality of pieces of extended high-band spectrum based on the low-band spectrum; and generating the phase information based on the plurality of pieces of extended high-band spectrum and the high-band spectrum, wherein each of the plurality of pieces of extended high-band spectrum is extended from the low-band spectrum and is generated by applying phase values to each of the plurality of sub-bands.

The generating of the phase information may include generating a plurality of candidate temporal envelopes by performing frequency-to-time transformation on the plurality of pieces of extended high-band spectrum; generating a temporal envelope by performing frequency-to-time transformation on the high-band spectrum; calculating degrees of similarity between the plurality of candidate temporal envelopes and the temporal envelope; and generating the phase information based on the calculated degrees of similarity.

The generating of the phase information may further include selecting a piece of extended high-band spectrum from among the plurality of pieces of extended high-band spectrum, based on degrees of similarity of the plurality of candidate temporal envelopes; and obtaining an index of a sub-band corresponding to the selected piece of extended high-band spectrum as the phase information.

The obtaining of the phase information may further include, when degrees of similarity of the plurality of candidate temporal envelopes with the temporal envelope are equal to or less than a threshold value, obtaining a random phase flag as the phase information.

The obtaining of the phase information may include generating a temporal envelope by performing frequency-to-time transformation on the high-band spectrum; and obtaining, when a degree of flatness of the temporal envelope is greater than a threshold value, a random phase flag as the phase information According to another aspect of an exemplary embodiment, there is provided an apparatus for encoding an audio signal, the apparatus including: a frequency transformation unit that is configured to generate a spectrum by performing frequency transformation on the audio signal; a spectrum separation unit that is configured to obtain, from the spectrum, a low-band spectrum in which a low-band signal is frequency transformed; a phase information obtaining unit that is configured to obtain phase information of a high-band spectrum based on the low-band spectrum; and a bitstream output unit that is configured to output a bitstream that comprises the phase information of the high-band spectrum.

According to another aspect of an exemplary embodiment, there is provided a method including receiving a low-band signal and phase information; generating a high-band spectrum from a low-band spectrum of the low-band signal in which the low-band signal is frequency transformed; and correcting a phase of the high-band spectrum based on the phase information.

The phase information may be based on the low-band spectrum.

The phase information may include at least one of information regarding whether or not to apply a random phase to at least some bands of the high-band spectrum and information regarding selecting at least some bands of the low-band spectrum.

The correcting of the phase may include obtaining phase values of at least some bands of the low-band spectrum based on the phase information; and applying the obtained phase values to at least some bands of the high-band spectrum.

The obtaining of the phase values may include determining a plurality of sub-bands comprised in the low-band spectrum; assigning an index to each of the plurality of sub-bands; generating a phase codebook by mapping phase values of each of the plurality of sub-bands to the assigned index of the sub-band; and obtaining the phase values based on the generated codebook.

The obtaining of the phase values may further include selecting an index from among a plurality of indices of the plurality of sub-bands based on the phase information; and obtaining phase values corresponding to the selected index from the phase codebook.

The correcting of the phase may include, when the phase information comprises a random phase flag, applying a random phase to at least some bands of the high-band spectrum.

According to another aspect of an exemplary embodiment, there is provided an apparatus for decoding an audio signal, the apparatus including a frequency transformation unit that is configured to generate a low-band spectrum by performing frequency transformation on a low-band signal; a frequency extension unit that is configured to generate a high-band spectrum from the low-band spectrum; and a phase correction unit that is configured to correct a phase of the high-band spectrum based on phase information.

According to another aspect of an exemplary embodiment, there is provided a non-transitory computer-readable recording medium having recorded thereon a program, which, when executed by a computer, performs a method comprising obtaining a low-band spectrum of an audio signal in which a low-band signal is frequency transformed; obtaining phase information of a high-band spectrum of the audio signal based on the low-band spectrum; and outputting a bitstream that comprises the phase information of the high-band spectrum.

According to another aspect of an exemplary embodiment, there is provided a non-transitory computer-readable recording medium having recorded thereon a program, which, when executed by a computer, performs a method comprising receiving a low-band signal and phase information; generating a high-band spectrum from a low-band spectrum of the low-band signal in which the low-band signal is frequency transformed; and correcting a phase of the high-band spectrum based on the phase information.

According to another aspect of an exemplary embodiment, there is provided a method of encoding an audio signal, the method comprising extracting a low-band spectrum of an audio signal; and encoding the audio signal by generating a high-band spectrum for the audio signal from the low-band spectrum and parameters of the low-band spectrum.

The parameters may be temporal information of the low-band spectrum.

The temporal information may be a temporal envelope of the low-band spectrum.

The high-band spectrum may be generated using a codebook comprising a plurality of sub-bands comprising the low-band spectrum and an assigned index assigned to each of the sub-bands.

According to another aspect of an exemplary embodiment, there is provided a method of correcting an audio signal, the method comprising extracting a low-band spectrum of an audio signal; extending the low-band spectrum to generate a high-band spectrum of the audio signal; and correcting a phase of the high-band spectrum of the audio signal.

The phase may be corrected using a phase codebook that comprises a phase values for a plurality of sub-bands of the low-band spectrum assigned to corresponding index values for the sub-bands.

BRIEF DESCRIPTION OF THE DRAWINGS

The above and/or other aspects will be more apparent by describing exemplary embodiments, with reference to the accompanying drawings, in which.

DETAILED DESCRIPTION OF EXEMPLARY EMBODIMENTS

Figure 1:
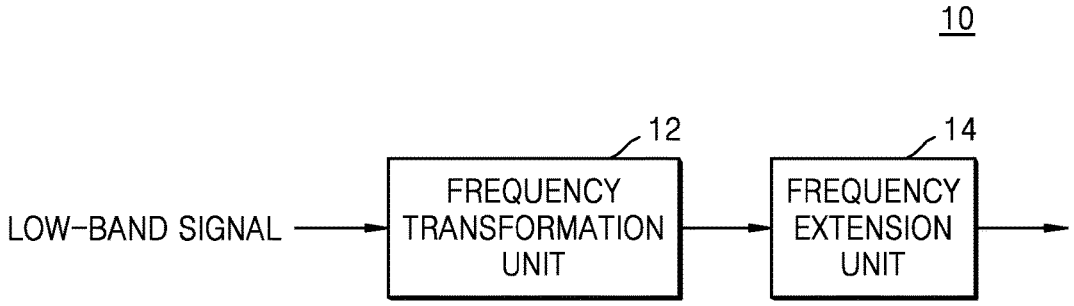
FIG. 1 is a block diagram of a general decoding apparatus generating a bandwidth-extended signal from a low-band signal.

Hereinafter, one or more exemplary embodiments will now be described more fully with reference to the accompanying drawings so that this disclosure will be thorough and complete, and will fully convey the inventive concept to one of ordinary skill in the art. The inventive concept may, however, be embodied in many different forms and should not be construed as being limited to the embodiments set forth herein. Features that are unnecessary for clearly describing the inventive concept are not included in the drawings. Also, throughout the specification, like reference numerals in the drawings denote like elements.

Throughout the specification, it will also be understood that when an element is referred to as being "connected to" another element, the element can be directly connected to the other element, or electrically connected to the other element while intervening elements may also be present. Also, when a part "includes" or "comprises" an element, unless there is a particular description contrary thereto, the part can further include other elements, not excluding the other elements.

The following terms may be interpreted according to the definition below. The terms that have not been described here may also be interpreted according to the intentions of the descriptions below. "Information" is a term that includes terms such as "value", "parameter", "coefficients", "elements", and the like, but exemplary embodiments are not limited thereto, and the term "information" may be interpreted differently according to the exemplary embodiments.

In a broad sense, an "audio signal" is a term that differs from the term "video signal" and may refer to a signal that may be auditorily identified when the signal is reproduced. In a narrow sense, the audio signal is a term that differs from a speech signal and may indicate a signal having no or little speech characteristics. In the exemplary embodiments, an audio signal is interpreted in a broad sense, but the audio signal may be understood in the narrow sense when the audio signal and the speech signal are distinguishably used.

A method and apparatus for encoding and decoding an audio signal may be a method and apparatus for encoding and decoding information regarding a spectrum in which signals are frequency transformed, or may be a method and apparatus for processing the audio signal, which includes the method and apparatus for encoding and decoding the frequency scale factors of the audio signal.

Hereinafter, exemplary embodiments will be described in detail with reference to the drawings.

FIG. 1 is a block diagram of a general decoding apparatus 10 that generates a bandwidth-extended signal from a low-band signal.

During a process of encoding and transmitting an audio signal and decoding transmitted information to thus generate the audio signal, an encoding apparatus may not transmit full band information of the audio signal, but only transmit low band information. Alternatively, the encoding apparatus may not directly transmit high band information, but instead may only transmit a small amount of correction information that is used for high band extension, and thus reduce transmission data.

The general decoding apparatus 10 of FIG. 1 may generate a full band signal by extending a bandwidth of a received low-band signal, and thus recover the audio signal.

A frequency transformation unit 12 performs frequency transformation (or, time-to-frequency mapping) on the received low-band signal, and thus generates a time-frequency (T/F) spectrum of the received low-band signal. The received low-band signal may be a signal that is divided into lengths of time before being input. The lengths of time may be predetermined.

The frequency transformation unit 12 may perform frequency transformation on the low-band signal by using a quadrature mirror filter (QMF) bank method, a modified discrete cosine transform (MDCT) method, a fast Fourier transform (FFT) method, or the like. A spectrum generated by the frequency transformation unit 12 may be represented by a complex number, i.e., a real number and an imaginary number, or by amplitude and phase.

A frequency extension unit 14 generates a high-band spectrum from a low-band spectrum to thus generate a bandwidth-extended audio signal.

The frequency extension unit 14 may generate the high-band spectrum from the low-band spectrum according to provided rules and transmitted harmonic information.

Representative elements that determine auditory characteristics of the audio signal include a spectral envelope, a temporal envelope, a spectral harmonic structure, and the like. A high-band extension method allows an extended high-band spectrum to have a spectral envelope, a temporal envelope, and a spectral harmonic structure of the original high-band spectrum.

The frequency extension unit 14 performs frequency extension by using harmonic information so that an extended spectrum may have an original harmonic structure. The harmonic information may include pitch frequency.

Also, the frequency extension unit 14 may only copy a low-band spectrum without the harmonic information, use the copied low-band spectrum as the high-band spectrum, and thus extend the bandwidth of the audio signal.

In order to correct the high-band spectrum, the general decoding apparatus 10 may generate a spectral envelope by differentiating spectrum amplitudes for each frequency band of each time region and generate a temporal envelope by differentiating spectrum amplitudes for each time region of each frequency band. The general decoding apparatus 10 may change the spectrum amplitudes by a T/F block. Therefore, a resolution by which the general decoding apparatus 10 adjusts the spectral envelope and the temporal envelope is determined, according to a size of the T/F block.

For example, when the general decoding apparatus 10 corrects the temporal envelope by using at least 128 samples in the time domain, i.e., when the size of the T/F block is 128 samples in the time domain, the general decoding apparatus 10 may not adjust changes of the temporal envelope in the 128 samples. Since the general decoding apparatus 10 only corrects the temporal envelope in the time domain of a certain size of a T/F block (e.g., 128 samples) or above at once, the general decoding apparatus 10 may not correct the temporal envelope in detail. Here, the certain size of the T/F block may be predetermined. Therefore, the quality of the audio signal may be reduced depending on the size of the T/F block used by the general decoding apparatus 10.

Also, if the general decoding apparatus 10 corrects the temporal envelope in every T/F block of 128 samples, a large amount of correction information is used. Thus, the general decoding apparatus 10 may correct the temporal envelope by using a unit of 128 samples only in sections where the temporal envelope changes rapidly, and in other sections, the general decoding apparatus 10 may correct the temporal envelope by using a unit that is longer than 128 samples. However, the longer the time unit for correcting the temporal envelope becomes, the less amount of correction information is transmitted and the worse the quality of the audio signal becomes as the correction accuracy is reduced.

Therefore, it would be advantageous to have a method of more accurately correcting a temporal envelope of a high-band signal by using less bits of correction information.

A temporal envelope of the low-band spectrum and a temporal envelope of the high-band spectrum may change similarly. Therefore, when the low-band spectrum is extended to generate the high-band spectrum, a temporal envelope of the generated high-band spectrum may be corrected by using temporal envelope information of the low-band spectrum.

According to a method and apparatus for encoding/decoding the audio signal, according to an exemplary embodiment, a phase of the high-band signal is adjusted based on the low-band spectrum, and thus, it is possible to accurately correct the temporal envelope of the high-band signal. By adjusting a phase of a signal, a temporal envelope of the signal may be adjusted. The method of adjusting a phase of the signal to thus correct a temporal envelope is advantageous in that accurate correction is performed and additional operations for envelope adjustment are unnecessary. The additional operations may include, for example, searching for a sub-band having an envelope that is most similar to a high-band envelope in a low band and then using a location of a found sub-band as "correction information" for correcting a high-band signal. In this case, in order to apply a temporal envelope of the low band to a high band generated by extending the low band, operations such as inversely transforming a high-band spectrum into a time waveform, calculating an envelope of the time waveform, correcting the envelope of the inversely transformed high-band spectrum by using the temporal envelope of the low band, and transforming the inversely transformed high-band are used.

Also, according to the method and apparatus for encoding/decoding the audio signal, according to an exemplary embodiment, phase values of the high-band signal are not quantized as they are. Instead, by using few bits according to a correlation between an envelope of the low-band signal and an envelope of the high-band signal, information for correcting a phase of the high-band spectrum is quantized and transmitted.

Hereinafter, a method of adjusting the temporal envelope by using the phase of the high-band signal will be described in detail. When a spectrum is given with respect to a signal, the signal may be defined by Equation 1 below as a sum of cosine signals.

$$s(n) = \sum_{k=0}^{N-1} A(k)\cos\left(\frac{2\pi k}{N}n + \theta(k)\right) \quad \text{[Equation 1]}$$

A spectrum amplitude A(k) denotes an amplitude of each cosine signal having a frequency element $$\frac{2\pi k}{N},$$

and each cosine signal has a constant amplitude at an N-sample time region. A spectrum phase φ(k) denotes a relative location of each cosine signal. When cosine signals of various frequencies are combined, a temporal envelope of a combination signal is determined according to the spectrum phase. For example, when all phases of the cosine signal are changed in the same way, a shape of a temporal envelope does not change but it only seems as if the temporal envelope has moved on the time axis.

Therefore, the temporal envelope may be adjusted by adjusting phases of cosine signals from spectrum information. The method of correcting the temporal envelope by adjusting the phases of the cosine signals is advantageous in that an envelope may be corrected by using a resolution of a sample and that additional operations for adjusting the envelope are unnecessary.

However, phase values of a spectrum of the audio signal do not have a particular statistical property but have random properties. Thus, it is impossible to estimate or efficiently quantize a phase value and many bits are necessary when information regarding all phase values is transmitted.

According to the method and apparatus for encoding/decoding the audio signal, according to an exemplary embodiment, the phase values of the high-band signal are not quantized as they are. Instead, a correlation between an envelope of the low-band signal and an envelope of the high-band signal is used to transmit the phase values of the high-band signal.

According to the method and apparatus for encoding/decoding the audio signal, according to an exemplary embodiment, a phase codebook is generated by using phase information of the low-band signal and phase information that generates a desired envelope of the high-band signal is searched for in the phase codebook. An index of the phase codebook may be transmitted as information for correcting phases of the high-band signal. In this case, fewer bits are used to transmit the information for correcting the phases of the high-band signal.

Figure 2:
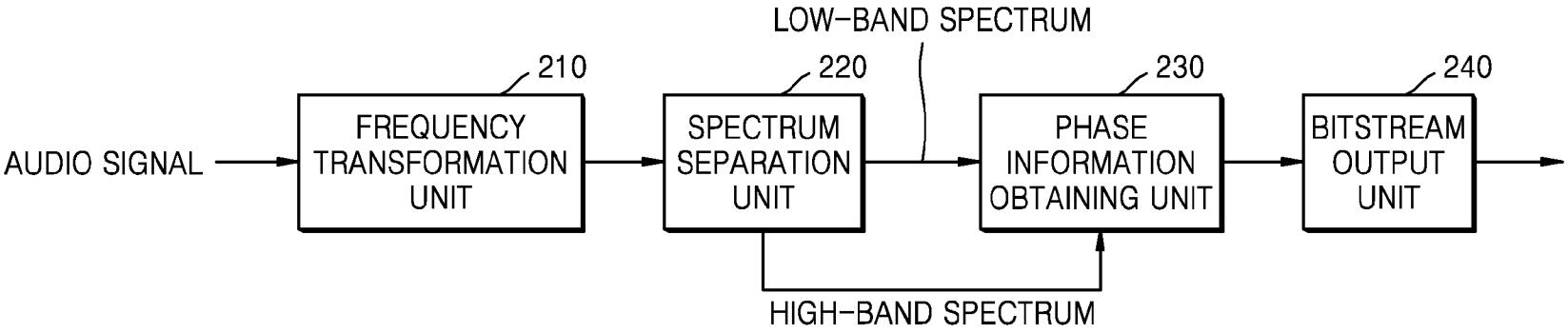
FIG. 2 is a block diagram of an apparatus for encoding an audio signal, according to an exemplary embodiment.

FIG. 2 is a block diagram of an apparatus 200 for encoding an audio signal (hereinafter, referred to as 'encoding apparatus'), according to an exemplary embodiment.

Referring to FIG. 2, the encoding apparatus 200 according to an exemplary embodiment may include a frequency transformation unit 210, a spectrum separation unit 220, a phase information obtaining unit 230, and a bitstream output unit 240.

The frequency transformation unit 210 may generate a spectrum by performing frequency transformation on the audio signal. For example, the frequency transformation unit 210 may perform the frequency transformation on the audio signal by using an FFT method, and thus provide the spectrum as amplitude and phase.

From the spectrum generated by the frequency transformation unit 210, the spectrum separation unit 220 may obtain a low-band spectrum in which a low-band signal is frequency transformed. Also, the spectrum separation unit 220 may obtain a high-band spectrum in which a high-band signal is frequency transformed. For example, the low-band signal may be a signal having a frequency in a range of about 0 to about 6.4 KHz, and the high-band signal may be a signal having a frequency in a range of about 6.4 to about 16 KHz.

The phase information obtaining unit 230 may obtain phase information of the high-band spectrum based on the low-band spectrum obtained in the spectrum separation unit 220. From the low-band spectrum, the phase information obtaining unit 230 may obtain phase values of at least some bands included in the low band as the phase information of the high-band spectrum. Phase information of the low-band spectrum is obtained as the phase information of the high-band spectrum because there is a close correlation between a temporal envelope of the low-band signal and a temporal envelope of the high-band signal.

The bitstream output unit 240 may output a bitstream that includes the phase information of the high-band spectrum obtained by the phase information obtaining unit 230. Also, the bitstream output unit 240 may output a bitstream that includes the phase information of the high-band spectrum as well as the low-band signal. The bitstream output unit 240 may quantize the low-band signal and output the quantized low-band signal as a bitstream by performing processes such as noiseless coding and bitstream packing.

The bitstream output unit 240 may quantize the low-band spectrum generated by the frequency transformation unit 210, or directly perform frequency transformation on the low-band signal and then quantize the frequency-transformed low-band signal. For example, a bitstream output by the encoding apparatus 200 may include a bitstream in which the low-band signal is frequency transformed by using an MDCT method and then quantized. Alternatively, a bitstream may be a bitstream that includes phase information of the high-band spectrum that is obtained based on the low-band spectrum that is frequency transformed by using an FFT method.

In order to increase encoding efficiency, the bitstream output unit 240 may assign many bits to encode the low-band signal, but fewer bits to encode the high-band signal. The bitstream output unit 240 may transmit not only the low-band signal, but also phase information for correcting the high-band signal that is generated by extending the low-band signal, as a bitstream. The decoding apparatus, which receives the bitstream form the encoding apparatus 200, may obtain the high-band signal that is generated by extending the low-band signal and correct the high-band signal by using the received phase information.

Figure 3:
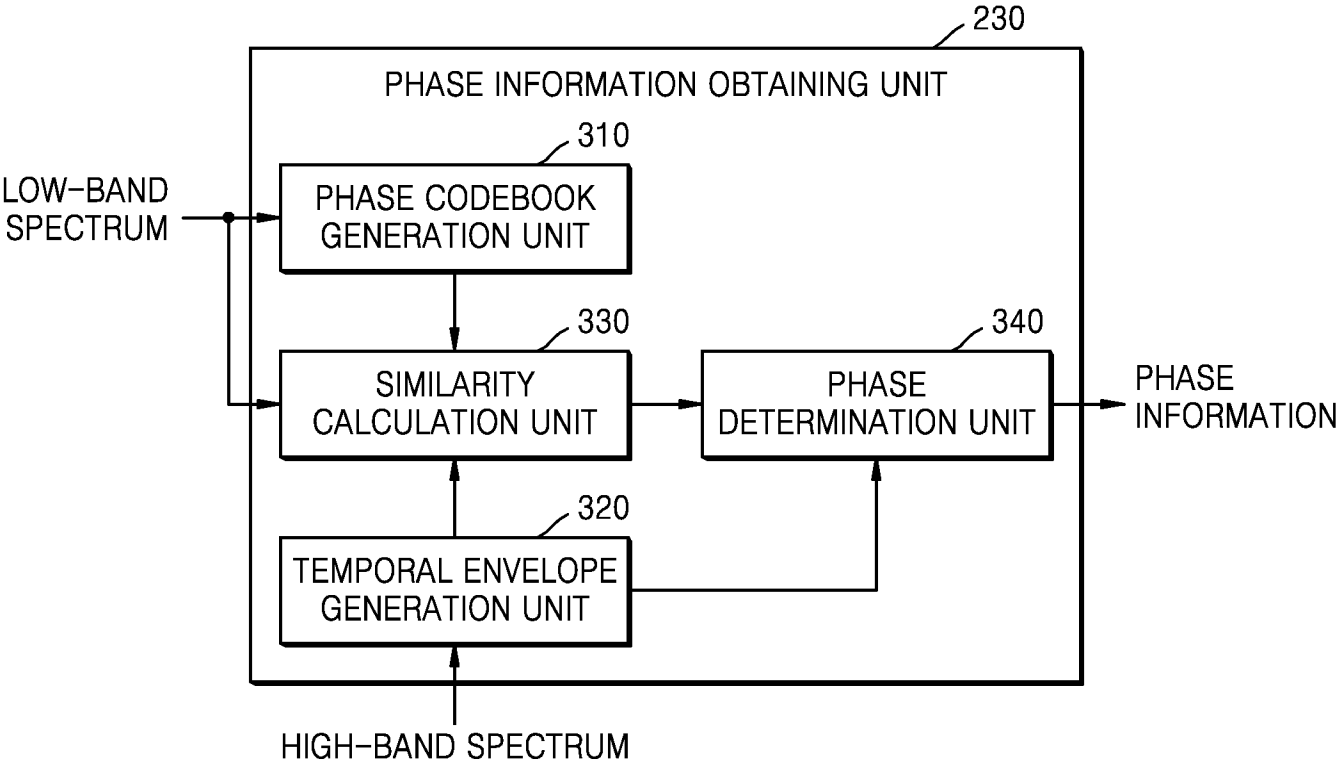
FIG. 3 is a block diagram of a phase information obtaining unit included in the apparatus for encoding audio signal, according to an exemplary embodiment.

FIG. 3 is a block diagram of the phase information obtaining unit 230 included in the encoding apparatus 200, according to an exemplary embodiment The phase information obtaining unit 230 may include a phase codebook generation unit 310, a temporal envelope generation unit 320, a similarity calculation unit 330, and a phase determination unit 340.

The phase codebook generation unit 310 may generate a phase codebook that includes the phase values of at least some of the bands of the low-band spectrum.

In order to generate the phase codebook, first, the phase codebook generation unit 310 may determine a plurality of sub-bands included in the low-band spectrum. The phase codebook generation unit 310 may assign an index to each sub-band.

For example, when the phase codebook generated by the phase codebook generation unit 310 has a size of 4, the phase codebook generation unit 310 may determine that four sub-bands are included in the low-band spectrum. The phase codebook generation unit 310 may assign indices '0', '1', '2', and '3' to the sub-bands, respectively.

The phase codebook generation unit 310 may generate the phase codebook by mapping phase values of each sub-band to an index of each sub-band and then storing the phase values and the indices. The phase codebook generation unit 310 may select a number of phase values in a sub-band and determine the selected phase values as a code vector of an index corresponding to the sub-band. The number of phase values may be predetermined.

The phase codebook will be described in detail with reference to FIGS. 4A and 4B.

The temporal envelope generation unit 320 may generate a temporal envelope by performing frequency-to-time transformation (or, frequency-to-time mapping) on the high-band band spectrum. The frequency-to-time transformation may be performed by using an inverse quadrature mirror filter (IQMF) bank method, an inverse modified discrete Fourier transform (IMDCT) method, an inverse fast Fourier transform (IFFT) method, or the like. For example, the temporal envelope generation unit 320 may use an IFFT method to generate the temporal envelope of the high-band signal from the high-band spectrum, but the exemplary embodiments are not limited thereto.

The similarity calculation unit 330 may calculate a degree of similarity between the temporal envelope of the high-band signal and a candidate temporal envelope that is extended from the low-band signal and corrected by using the phase codebook.

The similarity calculation unit 330 may generate a plurality of pieces of extended high-band spectrum based on the phase codebook generated by the phase codebook generation unit 310 and the low-band spectrum. The similarity calculation unit 330 may extend the low-band spectrum to generate the high-band spectrum, apply the phase values of the plurality of sub-bands recorded in the phase codebook to the generated high-band spectrum, and thus generate the plurality of pieces of extended high-band spectrum.

For example, assuming the phase codebook having a size of 4 described above, the similarity calculation unit 330 may generate a first extended high-band spectrum by applying phase values in a code vector of an index '0' recorded in the phase codebook to the high-band spectrum generated from the low-band spectrum. Also, the similarity calculation unit 330 may generate a second extended high-band spectrum by applying phase values in a code vector of an index '1' recorded in the phase codebook to the high-band spectrum generated from the low-band spectrum. Also, the similarity calculation unit 330 may generate a third extended high-band spectrum by applying phase values in a code vector of an index '2' recorded in the phase codebook to the high-band spectrum generated from the low-band spectrum. Also, the similarity calculation unit 330 may generate a fourth extended high-band spectrum by applying phase values in a code vector of an index '3' recorded in the phase codebook to the high-band spectrum generated from the low-band spectrum The similarity calculation unit 330 may generate a plurality of candidate temporal envelopes by performing frequency-to-time transformation on the plurality of pieces of extended high-band spectrum. The similarity calculation unit 330 may determine degrees of similarity between an actual temporal envelope generated from the high-band spectrum and candidate temporal envelopes generated from the low-band spectrum. The similarity calculation unit 330 may calculate degrees of similarity between the candidate temporal envelopes and the temporal envelope that is generated by the envelope generation unit 320. For example, a degree of similarity between a candidate temporal envelope and the temporal envelope may be calculated by using a correlation coefficient of the two temporal envelopes.

The phase determination unit 340 may generate the phase information based on at least one of degrees of similarity of the plurality of candidate temporal envelopes calculated by the similarity calculation unit 330 and the temporal envelope generated by the temporal envelope generation unit 320.

For example, the phase determination unit 340 may obtain phase information that is used to generate the temporal envelope generated from the high-band spectrum as the phase information for correcting the high-band signal.

The phase determination unit 340 may select a piece of extended high-band spectrum from the plurality of pieces of extended high-band spectrum, based on the degrees of similarity of the plurality of candidate temporal envelopes to the temporal envelope. In other words, from among the plurality of candidate temporal envelopes generated from the low-band spectrum, the phase determination unit 340 may select a candidate temporal envelope that is most similar to the temporal envelope that is generated from the high-band spectrum.

The phase determination unit 340 may select a piece of extended high-band spectrum that corresponds to the selected candidate temporal envelope. The phase determination unit 340 may obtain an index corresponding to the selected piece of extended high-band spectrum as the phase information. That is, the phase determination unit 340 may obtain an index corresponding to phase values used by the similarity calculation unit 330 in order to generate the selected piece of extended high-band spectrum, as the phase information, from the phase codebook.

As another example, the phase determination unit 340 may obtain random phase flags as the phase information.

When it is determined that there is no correlation between a candidate temporal envelope derived from the low-band spectrum and the actual temporal envelope generated from the high-band spectrum, correcting the temporal envelope of the high-band signal by using a random phase instead of phase values of the low-band spectrum may provide a better performance.

A random phase flag may be independently assigned for each sub-band of the high band. By outputting the random phase flag, the encoding apparatus 200 that includes the phase determination unit 340 may transmit phase information regarding applying a random phase to at least some sub-bands of the high-band spectrum that is generated by extending the low-band spectrum.

A single random phase flag may be commonly assigned to each sub-band of the high band. By outputting the random phase flag, the encoding apparatus 200 may transmit information regarding applying a random phase to all sub-bands of the high-band spectrum that is generated by extending the low-band spectrum.

The phase determination unit 340 may select a candidate temporal envelope having the highest degree of similarity to the temporal envelope from the plurality of candidate temporal envelopes. The phase determination unit 340 may compare a degree of similarity of the selected candidate temporal envelope to a threshold value. The threshold value may be predetermined.

When the degree of similarity of the selected candidate temporal envelope is less than the threshold value, the phase determination unit 340 may determine that none of the phase values of the sub-bands included in the low-band spectrum provide a candidate temporal envelope that is sufficiently similar to the actual temporal envelope of the high-band signal.

Correcting the temporal envelope of the high-band signal by using phase values of a sub-band corresponding to a degree of similarity less than the threshold value may cause the performance of the encoding apparatus 200 to decrease. In this case, instead of using the phase codebook, using a random phase to correct the temporal envelope of the high-band signal may provide a better performance.

Therefore, when the degrees of similarity of the plurality of candidate temporal envelopes to the temporal envelope are equal to or less than the threshold value, the phase determination unit 340 may obtain the random phase flag as the phase information.

As another example, the phase determination unit 340 may obtain the random phase flag as the phase information, based on a degree of flatness of the temporal envelope generated by the temporal envelope generation unit 320.

The phase determination unit 340 determines whether or not useful information is included in the temporal envelope generated by the temporal envelope generation unit 320. The phase determination unit 340 may determine that useful information is in the temporal envelope when there is a great change in the temporal envelope as time passes. The phase determination unit 340 may determine that useful information is not in the temporal envelope when there is no great change in the temporal envelope as time passes.

The phase determination unit 340 may calculate a degree of flatness of the temporal envelope to thus determine whether or not there is a great change in the temporal envelope as time passes. The phase determination unit 340 may determine that there is practically no change in the temporal envelope when the degree of flatness is high (i.e., when the temporal envelope is very flat) and that there is a great change in the temporal envelope when the degree of flatness is low (i.e., when the temporal envelope is not very flat).

For example, when a(n) refers to a temporal envelope signal, the phase determination unit 340 may use Equation 2 to calculate a degree of flatness of the temporal envelope.

$$\text{Degree of Flatness} = \frac{[\text{Geometric average of a } (n)]}{[\text{Arithmetic average of a } (n)]} \quad \text{[Equation 2]}$$

When the degree of flatness of the temporal envelope is equal to or less than a threshold value (i.e. when the temporal envelope is not very flat), the phase determination unit 340 may obtain the random phase flag as the phase information.

Figures 4A, 4B:
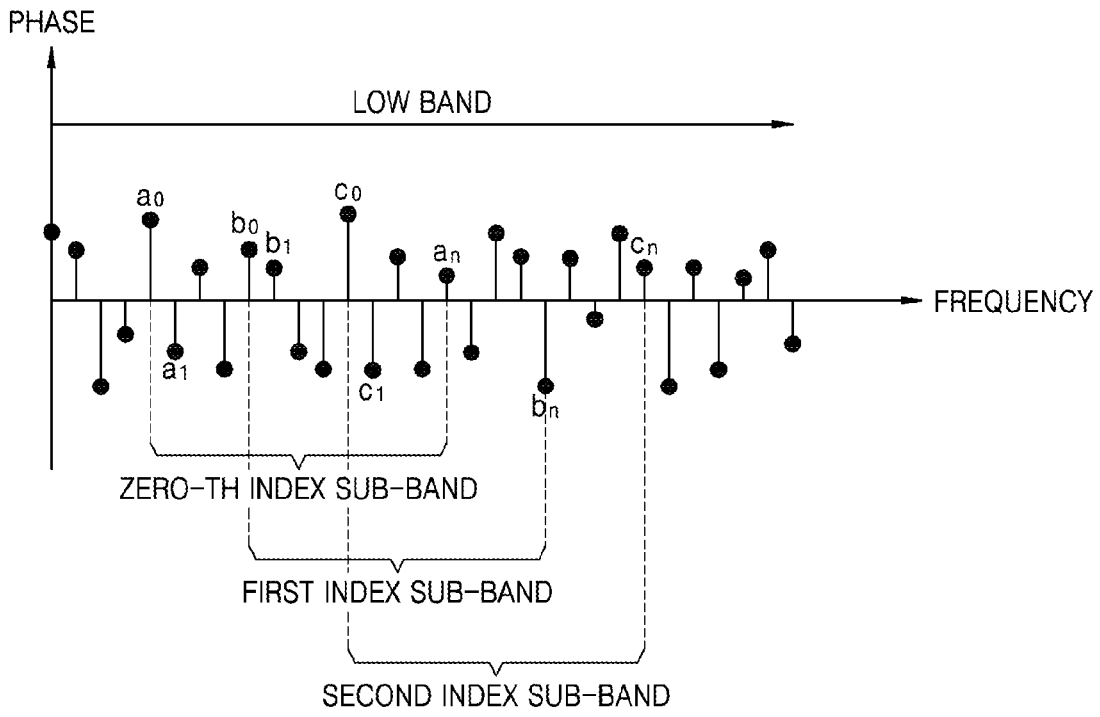
FIGS. 4A and 4B are views for explaining a phase codebook generated from a low-band spectrum, according to an exemplary embodiment.

FIGS. 4A and 4B are views for explaining the phase codebook generated from the low-band spectrum, according to an exemplary embodiment.

As described above with reference to FIG. 3, the phase codebook generation unit 310 included in the encoding apparatus 200 according to an exemplary embodiment may generate the phase codebook from the low-band spectrum.

As illustrated in FIG. 4A, the phase values of the low-band spectrum may be illustrated on a frequency-phase graph. The phase codebook generation unit 310 may determine the plurality of sub-bands included in the low-band spectrum. For example, the phase codebook generation unit 310 may determine 3 sub-bands that are included in the low band. However, the number of sub-bands is not particularly limited.

The phase codebook generation unit 310 may assign an index to each sub-band, select a number of phase values in a sub-band, and determine the selected phase values as a code vector of indices. The number of phase values in a sub-band may be predetermined.

The phase codebook generation unit 310 may determine a plurality of sub-bands having the same length by intervals. That is, the plurality of sub-bands may be determined such that the code vectors have a certain length and that frequencies corresponding to first phase values of the code vectors have certain intervals. The certain length may be predetermined, and the certain intervals may be predetermined.

The phase codebook generation unit 310 may generate the phase codebook by mapping indices of the plurality of sub-bands to the code vectors and then storing the indices and the code vectors.

The encoding apparatus 200 according to an exemplary embodiment may transmit indices of the phase codebook as the phase information for correcting phase values of at least some bands of the high-band signal. In order to transmit the phase information, the encoding apparatus 200 according to an exemplary embodiment may transmit phase information for each band of the high-band signal, or may transmit phase information that is commonly applied to all bands of the high-band signal.

As illustrated in of FIG. 4A, phase values $\{a_0, a_1, \ldots, a_n\}$ may be selected in a 'zero-th index sub-band'. Phase values $\{b_0, b_1, \ldots, b_n\}$ may be selected in a 'first index sub-band'. Phase values $\{c_0, c_1, \ldots, c_n\}$ may be selected in a 'second index sub-band'.

As illustrated in FIG. 4B, phase values that are selected for each sub-band are defined as code vectors of indices respectively corresponding to the sub-bands. For example, an index '0' and code vectors $\{a_0, a_1, \ldots, a_n\}$ are mapped and stored with respect to the 'zero-th index sub-band'.

The encoding apparatus 200 according to an exemplary embodiment may use a bitstream that includes a certain number of bits to transmit the phase information of the high-band spectrum. The certain number of bits may be predetermined.

For example, the encoding apparatus 200 according to an exemplary embodiment may use 2 bits for each sub-band of the high-band signal in order to transmit the phase information. However, the number of bits is not particularly limited and may be more than 2 bits. Therefore, as illustrated in FIG. 4B, when the phase codebook has a size of 3, a random phase flag may be used independently for the band assigned to index 3.

As illustrated in FIG. 4B, by outputting indices '0' to '2', the encoding apparatus 200 may induce a decoding apparatus 700 to use phase values of the low-band signal corresponding to received indices as the phase information of the high-band spectrum. Also, by outputting the index '3', the encoding apparatus 200 may induce the decoding apparatus 700 to use a random phase as the phase information of the high-band spectrum.

As another example, when the phase codebook has a size of 4 (that is, the phase codebook includes code vectors of which indices are 0, 1, 2, and 3), the encoding apparatus 200 according to an exemplary embodiment may transmit 2-bit phase information for each band and additionally transmit a 1-bit random phase flag that is commonly applied to all bands.

When a bit is assigned to a random phase flag, for example, by outputting '1' to an assigned bit, the encoding apparatus 200 may induce the decoding apparatus 700 to use a random phase as the phase information for all bands of the high band. Also, by outputting '0' to the assigned bit, the encoding apparatus 200 may induce the decoding apparatus 700 to use the phase values of the low-band signal corresponding to the received indices as the phase information of all bands of the high band.

Figure 5:
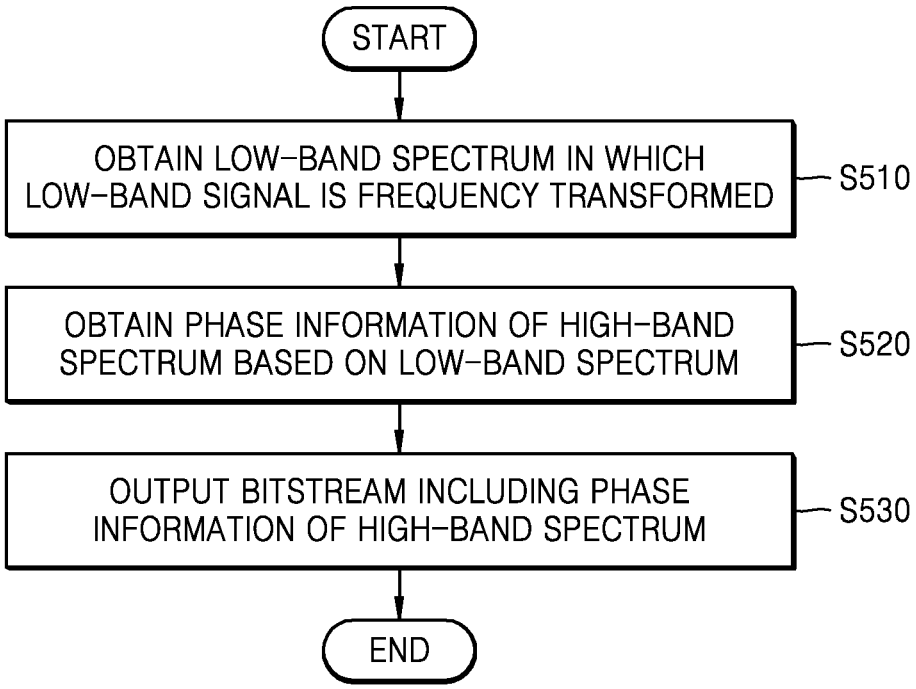
FIG. 5 is a flowchart of a method of encoding an audio signal, according to an exemplary embodiment.
Figure 6:
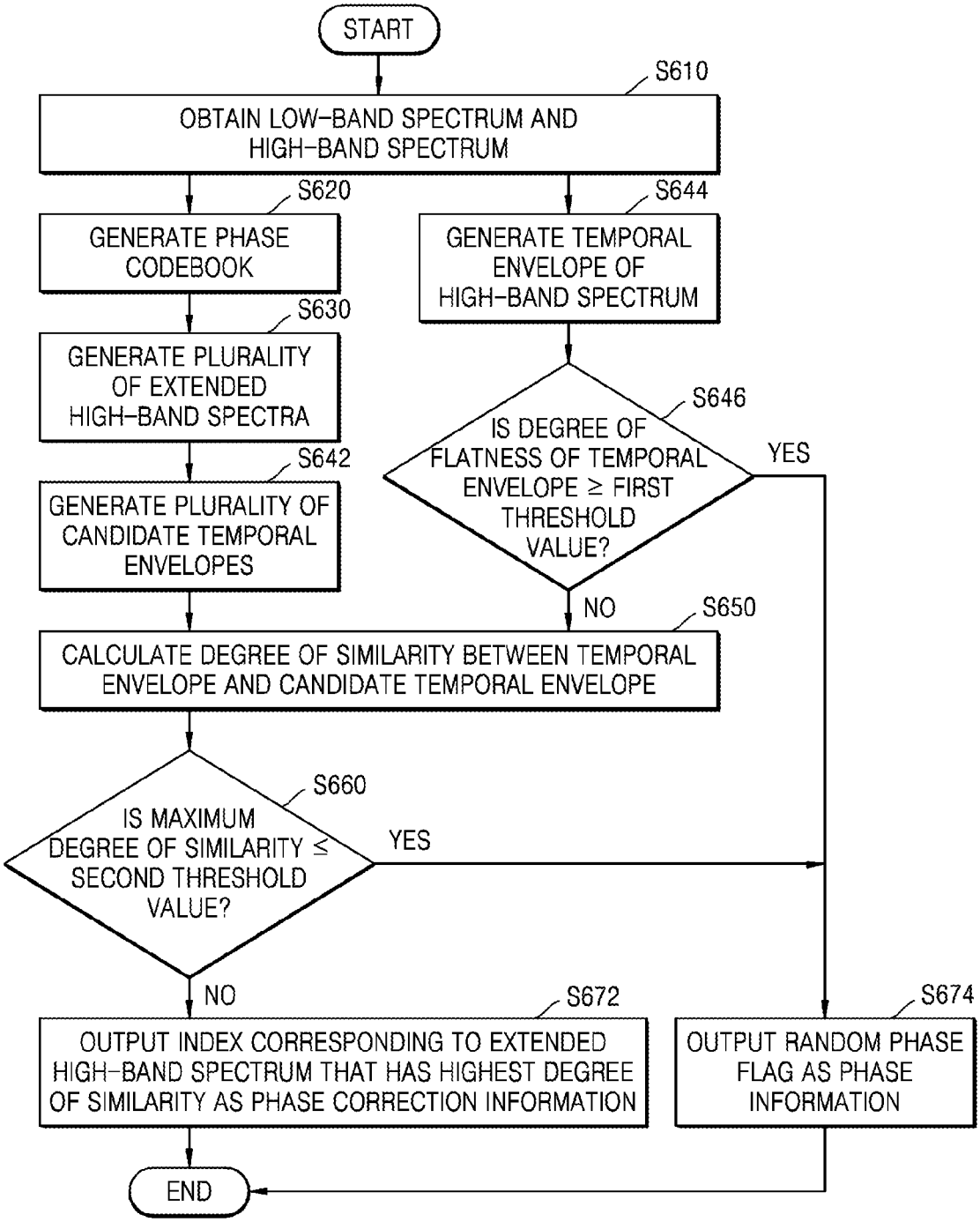
FIG. 6 is a detailed flowchart of a method of encoding an audio signal, according to an exemplary embodiment.

FIGS. 5 and 6 are flowcharts of methods of encoding an audio signal, according to embodiments of the present invention. Referring to FIGS. 5 and 6, the method of encoding the audio signal according to an exemplary embodiment includes operations performed by the encoding apparatus 200 illustrated in FIGS. 2 and 3. Therefore, the above-described features and elements of the encoding apparatus 200 of FIGS. 2 and 3 apply to the method of FIGS. 5 and 6.

FIG. 5 is a flowchart of the method of encoding the audio signal, according to an exemplary embodiment.

In operation S510, the encoding apparatus 200 may obtain a low-band spectrum in which a low-band signal is frequency transformed.

In operation S520, the encoding apparatus 200 may obtain phase information of a high-band spectrum based on the low-band spectrum.

The encoding apparatus 200 may generate a phase codebook that includes phase values of at least some bands included in the low-band spectrum. In order to generate the phase codebook, the encoding apparatus 200 may determine a plurality of sub-bands included in the low-band spectrum, assign an index to each sub-band, and map phase values of each sub-band to the index of each sub-band and thus store the phase values and the index.

Also, regarding the high-band spectrum generated by extending the low-band spectrum, the encoding apparatus 200 may generate a plurality of pieces of extended high-band spectrum by applying a plurality of code vectors of the phase codebook. The encoding apparatus 200 may obtain an index of a sub-band that corresponds to a temporal envelope, which is most similar to an actual temporal envelope generated from the high-band spectrum from among a plurality of candidate temporal envelopes generated from the plurality of pieces of extended high-band spectrum, as the phase information.

When degrees of similarity between the plurality of candidate temporal envelopes and the temporal envelope are all equal to or less than a threshold value (i.e., when all the candidate temporal envelopes are not similar to the temporal envelope), the encoding apparatus 200 may obtain a random phase flag as the phase information. By outputting the random phase flag, the encoding apparatus 200 may induce the decoding apparatus 700 to use a random phase as the phase information of the high-band spectrum.

Additionally or alternatively, the encoding apparatus 200 may calculate a degree of flatness of the actual temporal envelope generated from the high-band spectrum, and when the degree of flatness is greater than a threshold value (i.e., when the actual temporal envelope is flat), the encoding apparatus 200 may obtain the random phase flag as the phase information.

In operation S530, the encoding apparatus 200 may output a bitstream that includes the low-band signal and the phase information of the high-band spectrum.

FIG. 6 is a detailed flowchart of the method of encoding the audio signal, according to an exemplary embodiment.

In operation S610, the encoding apparatus 200 may obtain a low-band spectrum and a high-band spectrum. For example, the encoding apparatus 200 may perform frequency transformation on an input audio signal and thus obtain spectrum of the audio signal, and may separate the spectrum of the audio signal to thus obtain a low-band spectrum and a high-band spectrum.

In operation S620, the encoding apparatus 200 may generate a phase codebook from the low-band spectrum.

In operation S630, the encoding apparatus 200 may generate a plurality of extended high-band spectra. For example, the encoding apparatus 200 may extend the low-band spectrum to generate the extended high-band spectrum. The encoding apparatus 200 may copy code vectors that correspond to indices of the phase codebook, apply the copied code vectors to phases of the extended high-band spectrum to thus generate a plurality of pieces of extended high-band spectrum. The encoding apparatus 200 may generate the plurality of pieces of extended high-band spectrum from an extended high-band spectrum of which a size and a tonality of a spectrum are corrected.

In operation S642, the encoding apparatus 200 may generate a plurality of candidate temporal envelopes from the plurality of pieces of extended high-band spectrum.

In operation S644, the encoding apparatus 200 may generate a temporal envelope of the high-band spectrum.

In operation S646, the encoding apparatus 200 analyzes the temporal envelope to determine whether or not useful envelope information is in the temporal envelope and determines to use a random phase when there is no useful envelope information (i.e., when the degree of flatness indicates that the temporal envelope is very flat).

When there is practically no change in the temporal envelope, the encoding apparatus 200 may determine that the temporal envelope does not include the useful envelope information. When a degree of flatness of the temporal envelope is greater than a first threshold value, the encoding apparatus 200 may output a random phase flag as the phase information (operation S674).

In operation S650, the encoding apparatus 200 may calculate degrees of similarity between the plurality of candidate temporal envelopes generated in operation S642 and the temporal envelope generated in operation S644. Regarding a plurality of indices included in the phase codebook, the encoding apparatus 200 repeatedly calculates degrees of similarity between candidate temporal envelopes corresponding to the indices and an actual temporal envelope.

In operation S660, the encoding apparatus 200 may determine whether a maximum degree of similarity between the candidate temporal envelopes and the temporal envelope is less than a second threshold value. Here, the encoding apparatus 200 may analyze whether the temporal envelope of the high-band signal and candidate temporal envelopes predicted from the low-band signal are sufficiently similar to each other. That is, when calculated degrees of similarity are all equal to or less than a second threshold value, the encoding apparatus 200 determines that the candidate temporal envelopes and the temporal envelope are not sufficiently similar to each other and outputs the random phase flag as the phase information (operation S674).

Also, when a degree of similarity of a candidate temporal envelope, which is determined as most similar to the temporal envelope, is less than the second threshold value, the encoding apparatus 200 may determine that all phase values of sub-bands of the low-band signal do not provide a desirable temporal envelope. In this case, the encoding apparatus 200 may output the random phase flag as the phase information (operation S674).

The encoding apparatus 200 may determine the random phase flag by using the degree of flatness of the temporal envelope in operation S646, and then calculating the degrees of similarity between the plurality of candidate temporal envelopes and the temporal envelope in operation S660.

The random phase flag may be independently assigned to each sub-band of the high band, or a single random phase flag may be commonly assigned to all bands by aggregating the status of all bands.

On the other hand, when it is determined that the maximum degree of similarity is greater than the second threshold value (S660, NO), the encoding apparatus 200 may output an index providing the highest degree of similarity as phase correction information in operation S672.

Based on the calculated degrees of similarity, the encoding apparatus 200 may select a candidate temporal envelope that is determined to be most similar to the temporal envelope from the plurality of candidate temporal envelopes. The encoding apparatus 200 may select an extended high-band spectrum that corresponds to the selected candidate temporal envelope. The encoding apparatus 200 may output an index corresponding to a code vector which is applied to generate the selected extended high-band spectrum as the phase information.

Figure 7:
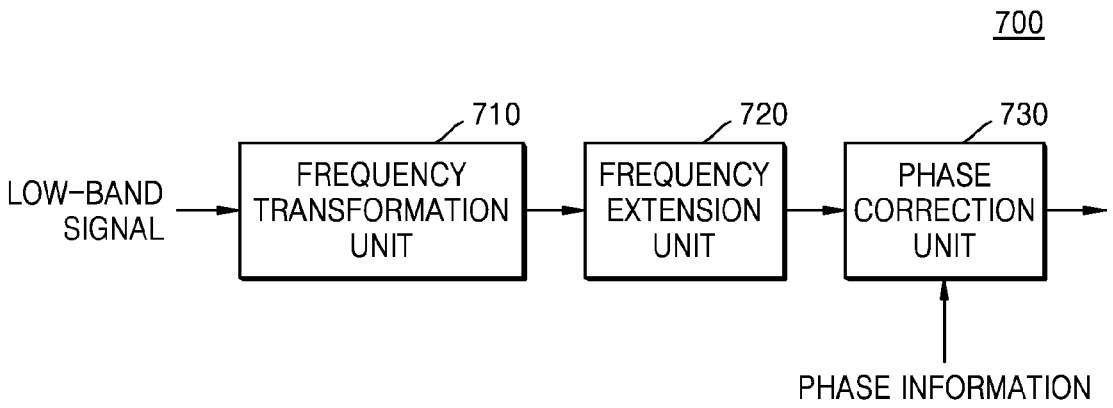
FIG. 7 is a block diagram of an apparatus for decoding an audio signal, according to an exemplary embodiment.

FIG. 7 is a block diagram of the decoding apparatus 700 according to an exemplary embodiment.

Referring to FIG. 7, the decoding apparatus 700 according to an exemplary embodiment may include a frequency transformation unit 710, a frequency extension unit 720, and a phase correction unit 730. A received low-band signal may be a signal that is recovered by inversely quantizing or inversely transforming (or, frequency-to-time transforming) a bitstream that is externally input.

The frequency transformation unit 710 may generate a low-band spectrum by performing frequency transformation on the received low-band signal.

A low-band signal received by the frequency transformation unit 710 may be a signal in which low-band encoding information is decoded by a low-band decoding apparatus (not shown). The low-band encoding information may be a frequency-transformed audio signal that is output as a bitstream by performing processes such as quantizing, noiseless coding, and bitstream packing.

The frequency transformation unit 710 may perform frequency transformation on the low-band signal by using a QMF bank method, an MDCT method, an FFT method, or the like, but the embodiments of the present invention are not limited thereto. For example, the frequency transformation unit 710 may generate the low-band spectrum by using an FFT method so that the generated low-band spectrum may be presented as amplitude and phase of a signal.

The frequency extension unit 720 may generate a high-band spectrum from the low-band spectrum in which a low-band signal is frequency transformed.

Based on received phase information, the phase correction unit 730 may correct phases of the high-band spectrum generated by the frequency extension unit 720. The decoding apparatus 700 may additionally include a size correction unit (not shown) between the frequency extension unit 720 and the phase correction unit 730. The size correction unit may correct a size and a tonality of the high-band spectrum by using size correction information and may input a high-band spectrum of which the size and the tonality are corrected to a spectrum synthesis unit 830 of the phase correction unit 730.

The decoding apparatus 700 according to an exemplary embodiment may generate a phase codebook from the low-band spectrum, search for phase values corresponding to received phase information from the phase codebook, and determine phase values that are found from the phase codebook as information for correcting phases of an extended high-band spectrum. The decoding apparatus 700 may inversely transform and then output a high-band spectrum of which phases are corrected.

Correcting the phases of the high-band spectrum via the phase correction unit 730 of the decoding apparatus 700 will be described in detail with reference to FIG. 8.

Figure 8:
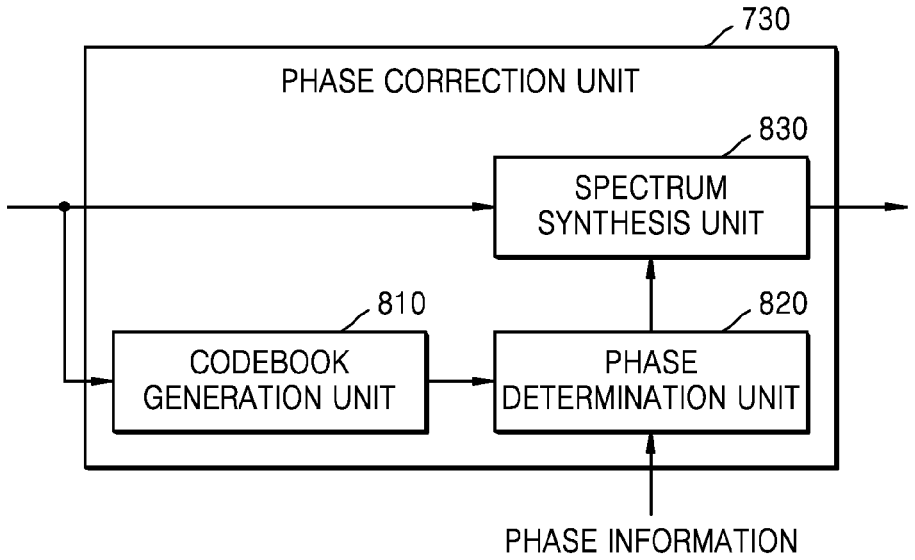
FIG. 8 is a block diagram of a phase correction unit included in the apparatus for decoding an audio signal, according to an exemplary embodiment.

FIG. 8 is a block diagram of the phase correction unit 730 included in the decoding apparatus 700, according to an exemplary embodiment.

Referring to FIG. 8, the phase correction unit 730 according to an exemplary embodiment may include a codebook generation unit 810, a phase determination unit 820, and the spectrum synthesis unit 830.

The codebook generation unit 810 may generate the phase codebook based on an input low-band spectrum. The codebook generation unit 810 of FIG. 8 corresponds to the phase codebook generation unit 310 of FIG. 3, and thus the description of the same elements and features will be omitted.

Sizes (that is, the number of included indices, lengths of included code vectors) of phase codebooks generated by the codebook generation unit 810 of FIG. 8 and the phase codebook generation unit 310 of FIG. 3 may be predetermined. Also, the encoding apparatus 200 according to an exemplary embodiment may transmit information (e.g., a size of a phase codebook) regarding the phase codebook to the decoding apparatus 700.

Phase information that is input to the phase determination unit 820 may include at least one of information regarding whether or not to apply a random phase to the high-band spectrum, and information regarding selecting at least some bands of the low-band spectrum.

When the phase information includes information regarding selecting sub-bands of the low-band spectrum, the phase determination unit 820 may determine to apply phase values of the selected sub-bands of the low-band spectrum to at least some bands of the high-band spectrum. The phase information may include indices of the phase codebook as information for selecting sub-bands of the low-band spectrum. In this case, the phase determination unit 820 may search for a code vector corresponding to an input index from the phase codebook and output phase values included in a found code vector to the spectrum synthesis unit 830.

When the phase information includes a random phase flag, the phase determination unit 820 may determine to apply a random phase to at least some bands of the high-band spectrum. In this case, the phase determination unit 820 may output a random phase to the spectrum synthesis unit 830.

When the phase information does not include the random phase flag, the phase determination unit 820 may determine not to apply the random phase to at least some bands of the high-band spectrum. When the phase determination unit 820 has determined not to apply the random phase to at least some bands of the high-band spectrum based on the phase information, the phase determination unit 820 may obtain an index included in the phase information.

The phase determination unit 820 may search for an index included in the phase information from the phase codebook generated by the codebook generation unit 810. The phase determination unit 820 may copy phase values corresponding to a found index and output the copied phase values to the spectrum synthesis unit 830.

The phase information that is input to the phase determination unit 820 may be information that is commonly applied to all sub-bands of the high band, or may be information that is independently applied to each sub-band of the high-band spectrum. For example, the phase information that is input to the phase determination unit 820 may be 2-bit information that is independently assigned to each sub-band of the high band. As another example, the phase information may include a 1-bit random phase flag that is commonly applied to all sub-bands of the high band and 2-bit information that is independently assigned to each sub-band. A length of a bitstream that transmits the phase information may be related to the number of indices included in the phase codebook.

The spectrum synthesis unit 830 combines amplitudes of the high-band spectrum generated by the frequency extension unit 720 of FIG. 7 and the phase values output by the phase determination unit 820 to thus generate and output a new spectrum.

Figure 9:
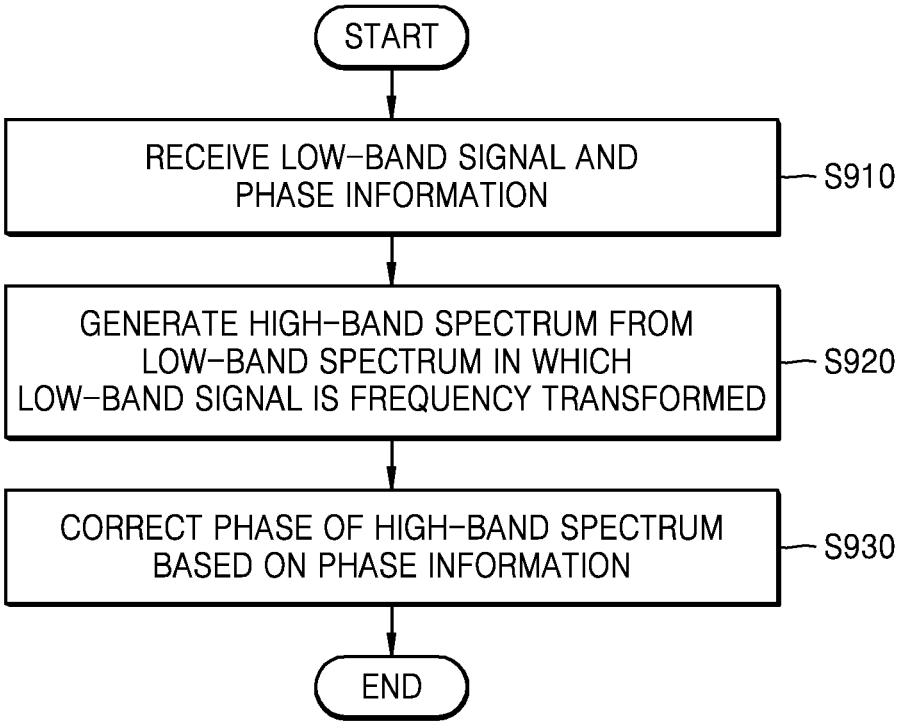
FIG. 9 is a flowchart of a method of decoding an audio signal, according to an exemplary embodiment.
Figure 10:
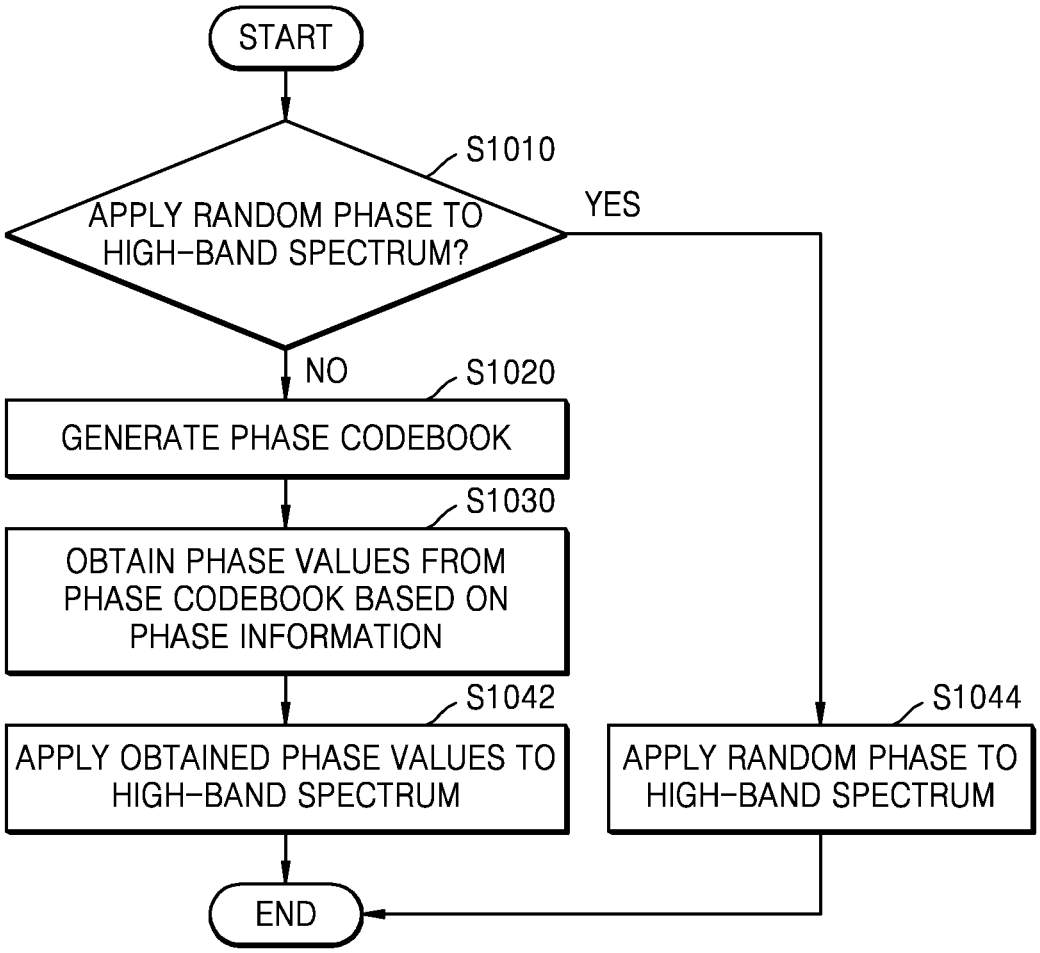
FIG. 10 is a flowchart of a phase correction operation included in the method of encoding an audio signal, according to an exemplary embodiment.

FIGS. 9 and 10 are flowcharts of a method of decoding an audio signal, according to an exemplary embodiment. Referring to FIGS. 9 and 10, the method of decoding the audio signal, according to exemplary embodiments, includes operations performed by the decoding apparatus 700 of FIGS. 7 and 8. Therefore, the above-described features and elements of the decoding apparatus 700 of FIGS. 7 and 8 apply to the method of FIGS. 9 and 10.

FIG. 9 is a flowchart of the method of decoding the audio signal, according to an exemplary embodiment.

In operation S910, the decoding apparatus 700 may receive a low-band signal and phase information. The received low-band signal may be a signal that is recovered by inversely quantizing or inversely transforming (or, frequency-to-time transforming) a bitstream that is externally input.

In operation S920, the decoding apparatus 700 may generate a high-band spectrum from a low-band spectrum in which the low-band signal is frequency transformed. The decoding apparatus 700 may perform frequency transformation on the received low-band signal. The decoding apparatus 700 may generate a high-band spectrum from a low-band spectrum in which the low-band signal is frequency transformed.

In operation S930, the decoding apparatus 700 may correct a phase of the high-band spectrum based on the phase information.

The phase information may be generated based on a spectrum of the low-band signal. The phase information may include at least one of information regarding whether or not to apply a random phase to the high-band spectrum that is generated from the low-band spectrum and information regarding selecting at least some bands of the low-band spectrum.

The decoding apparatus 700 may obtain phase values of at least some of the bands of the low-band spectrum based on the phase information. In operation S920, the decoding apparatus 700 may apply the obtained phase values to the generated high-band spectrum.

The decoding apparatus 700 may generate a phase codebook to obtain the phase values of at least some bands of the low-band spectrum based on the phase information.

In order to generate the phase codebook, first, the decoding apparatus 700 may determine a plurality of sub-bands included in the low-band spectrum. The plurality of sub-bands included in the low-band spectrum may have lengths and intervals. The lengths may be predetermined and the intervals may be predetermined.

The decoding apparatus 700 may assign an index to each sub-band, map phase values of each sub-band to the index of each sub-band, and thus generate the phase codebook.

The phase values of each sub-band may be included in the phase codebook as a code vector that includes a number of phase values that are selected in a sub-band. The number of phases may be predetermined.

The decoding apparatus 700 may select an index from a plurality of indices of the plurality of sub-bands based on the phase information. The decoding apparatus 700 may obtain phase values that correspond to the selected index from the phase codebook.

Also, when the phase information includes a random phase flag, the decoding apparatus 700 may apply a random phase and correct the high-band spectrum.

Operation S930, in which the decoding apparatus 700 corrects phases of the high-band spectrum based on the phase information, will be described in detail with reference to FIG. 10.

FIG. 10 is a flowchart of a phase correction operation included in the method of encoding an audio signal, according to an exemplary embodiment.

In operation S1010, the decoding apparatus 700 may determine whether or not to apply the random phase to the high-band spectrum.

The decoding apparatus 700 may obtain information regarding whether or not to apply the random phase to the high-band spectrum from the phase information. The information regarding whether or not to apply the random phase to the high-band spectrum may include the random phase flag. The random phase flag may indicate whether or not to commonly apply the random phase to all sub-bands of the high-band spectrum. Alternatively, the random phase flag may indicate whether or not to independently apply the random phase to each sub-band of the high-band spectrum.

When it is determined to not to apply the random phase (S1010, NO), the decoding apparatus 700 may generate the phase codebook from the low-band spectrum in operation S1020. The generated phase codebook may include phase values of at least some of the bands of the low-band spectrum.

In operation S1030, the decoding apparatus 700 may obtain phase values from the phase codebook based on the phase information. The phase information may include an index included in the phase codebook.

The decoding apparatus 700 may search for a code vector corresponding to the index included in the phase information from the phase codebook. A plurality of code vectors may be mapped to a plurality of indices and thus stored in the phase codebook. The decoding apparatus 700 may use phase values obtained based on a found code vector as correction information regarding the high-band spectrum.

In operation S1042, the decoding apparatus 700 may apply the obtained phase values to the high-band spectrum. The decoding apparatus may correct a temporal envelope of the high-band signal by applying the phase values obtained in operation S1030 to the high-band spectrum generated in operation S920 of FIG. 9.

On the other hand, when it is determined to apply the random phase (S1010, YES), the decoding apparatus 700 may apply the random phase in operation S1044. The decoding apparatus 700 may apply the random phase to the high-band spectrum generated in operation S920 of FIG. 9.

As described above, when phases of the high-band spectrum that is generated by extending the low-band spectrum are corrected by using the method of decoding the audio signal, according to an exemplary embodiment, the temporal envelope of the high-band signal may be corrected. In particular, by using the method of decoding the audio signal, according to an exemplary embodiment, it is possible to correct a temporal envelope by units of 1 sample, and thus, the temporal envelop may be accurately adjusted based on high time resolution.

While the above describes various exemplary embodiments implemented by circuitry, other exemplary embodiments may also be implemented through computer-readable code/instructions in/on a medium, e.g., a computer-readable medium, to control at least one processing element to implement the functionalities of any above-described exemplary embodiment. The medium can correspond to any medium/media permitting the storage and/or transmission of the computer-readable code.

The computer-readable code can be recorded/transferred on a medium in a variety of ways, with examples of the medium including recording media, such as magnetic storage media (e.g., ROM, floppy disks, hard disks, etc.) and optical recording media (e.g., CD-ROMs, DVDs, etc.), and transmission media such as Internet transmission media. Thus, the medium may be such a defined and measurable structure including or carrying a signal or information, such as a device carrying a bitstream, according to one or more embodiments of the present invention. The media may also be a distributed network, so that the computer-readable code is stored/transferred and executed in a distributed fashion. Furthermore, the processing element could include a processor or a computer processor, and processing elements may be distributed and/or included in a single device.

It should be understood that the exemplary embodiments described herein should be considered in a descriptive sense only and not for purposes of limitation. Descriptions of features or aspects within each embodiment should typically be considered as available for other similar features or aspects in other embodiments.

While one or more exemplary embodiments have been described with reference to the figures, it will be understood by those of ordinary skill in the art that various changes in form and details may be made therein without departing from the spirit and scope of the present inventive concept as defined by the following claims.

The invention claimed is:

1. A method of encoding an audio signal, the method comprising:

obtaining a low-band spectrum of an audio signal in which a low-band signal is frequency transformed;

obtaining phase information of a high-band spectrum of the audio signal based on the low-band spectrum; and outputting a bitstream that comprises the phase information of the high-band spectrum, wherein the obtaining of the phase information comprises:

generating a phase codebook comprising phase values of each of a plurality of sub-bands comprised in the low-band spectrum;

generating a plurality of pieces of extended high-band spectrum based on the low-band spectrum; and generating the phase information based on the plurality of pieces of extended high-band spectrum and the high-band spectrum, and wherein each of the plurality of pieces of extended high-band spectrum is extended from the low-band spectrum and is generated by applying the phase values to each of the plurality of sub-bands.

2. The method of claim 1, wherein the generating the phase codebook comprises:

determining the plurality of sub-bands comprised in the low-band spectrum;

assigning an index to each of the plurality of sub-bands; and mapping phase values of each of the plurality of sub-bands to the assigned index of the sub-band.

3. The method of claim 1, wherein the generating of the phase information comprises:

generating a plurality of candidate temporal envelopes by performing frequency-to-time transformation on the plurality of pieces of extended high-band spectrum;

generating a temporal envelope by performing frequency-to-time transformation on the high-band spectrum;

calculating degrees of similarity between the plurality of candidate temporal envelopes and the temporal envelope; and generating the phase information based on the calculated degrees of similarity.

4. The method of claim 3, wherein the generating of the phase information further comprises:

selecting a piece of extended high-band spectrum from among the plurality of pieces of extended high-band spectrum, based on degrees of similarity of the plurality of candidate temporal envelopes; and obtaining an index of a sub-band corresponding to the selected piece of extended high-band spectrum as the phase information.

5. The method of claim 3, wherein the obtaining of the phase information further comprises, when degrees of similarity of the plurality of candidate temporal envelopes with the temporal envelope are equal to or less than a threshold value, obtaining a random phase flag as the phase information.

6. The method of claim 1, wherein the obtaining of the phase information further comprises:

generating a temporal envelope by performing frequency-to-time transformation on the high-band spectrum; and obtaining, when a degree of flatness of the temporal envelope is greater than a threshold value, a random phase flag as the phase information.

7. An apparatus for encoding an audio signal, the apparatus comprising:

a frequency transformation unit that is configured to generate a spectrum by performing frequency transformation on the audio signal; a spectrum separation unit that is configured to obtain, from the spectrum, a low-band spectrum in which a low-band signal is frequency transformed;

a phase information obtaining unit that is configured to obtain phase information of a high-band spectrum based on the low-band spectrum; and a bitstream output unit that is configured to output a bitstream that comprises the phase information of the high-band spectrum, wherein the phase information obtaining unit is further configured to:

generate a phase codebook comprising phase values of each of a plurality of sub-bands comprised in the low-band spectrum;

generate a plurality of pieces of extended high-band spectrum based on the low-band spectrum; and generate the phase information based on the plurality of pieces of extended high-band spectrum and the high-band spectrum, and wherein each of the plurality of pieces of extended high-band spectrum is extended from the low-band spectrum and is generated by applying the phase values to each of the plurality of sub-bands.

8. A method of decoding an audio signal, the method comprising:

receiving a low-band signal and phase information, wherein the phase information is based on a low-band spectrum in which the low-band signal is frequency transformed;

generating a high-band spectrum from the low-band spectrum; and correcting a phase of the high-band spectrum based on the phase information, wherein the correcting of the phase comprises:

obtaining phase values of at least some bands of the low-band spectrum based on the phase information; and applying the obtained phase values to at least some bands of the high-band spectrum, wherein the obtaining of the phase values comprises:

determining a plurality of sub-bands comprised in the low-band spectrum;

assigning an index to each of the plurality of sub-bands;

generating a phase codebook by mapping phase values of each of the plurality of sub-bands to the assigned index of the sub-band; and obtaining the phase values based on the generated codebook.

9. The method of claim 8, wherein the phase information comprises at least one of information regarding whether or not to apply a random phase to at least some bands of the high-band spectrum and information regarding selecting at least some bands of the low-band spectrum.

10. The method of claim 8, wherein the obtaining of the phase values further comprises:

selecting an index from among a plurality of indices of the plurality of sub-bands based on the phase information; and obtaining phase values corresponding to the selected index from the phase codebook.

11. The method of claim 8, wherein the correcting of the phase comprises, when the phase information comprises a random phase flag, applying a random phase to at least some bands of the high-band spectrum.

12. An apparatus for decoding an audio signal, the apparatus comprising:

a frequency transformation unit that is configured to generate a low-band spectrum by performing frequency transformation on a low-band signal; a frequency extension unit that is configured to generate a high-band spectrum from the low-band spectrum; and a phase correction unit that is configured to correct a phase of the high-band spectrum based on phase information, wherein the phase information is based on the low-band spectrum, wherein the phase correction unit is further configured to:

obtain phase values of at least some bands of the low-band spectrum based on the phase information; and apply the obtained phase values to at least some bands of the high-band spectrum, wherein the phase correction unit further configured to:

determine a plurality of sub-bands comprised in the low-band spectrum;

assign an index to each of the plurality of sub-bands;

generate a phase codebook by mapping phase values of each of the plurality of sub-bands to the assigned index of the sub-band; and obtain the phase values based on the generated codebook.

13. A non-transitory computer-readable recording medium having recorded thereon a program, which, when executed by a computer, performs the method of claim 1.

14. A non-transitory computer-readable recording medium having recorded thereon a program, which, when executed by a computer, performs the method of claim 8.

* * * * *